United States Patent [19]

Adams

[11] 4,100,080

[45] Jul. 11, 1978

[54] GREASES CONTAINING BORATE DISPERSIONS AS EXTREME-PRESSURE ADDITIVES

[75] Inventor: John Howard Adams, San Rafael, Calif.

[73] Assignee: Chevron Research Company, San Francisco, Calif.

[21] Appl. No.: 777,367

[22] Filed: Mar. 14, 1977

[51] Int. Cl.[2] ..... C10M 3/18; C10M 5/14; C10M 7/20; C10M 7/24

[52] U.S. Cl. ..... 252/18; 252/25

[58] Field of Search ..... 252/18, 25

[56] References Cited

U.S. PATENT DOCUMENTS

| | | | |
|---|---|---|---|
| 3,243,372 | 3/1966 | Dreher et al. | 252/51.5 A |
| 3,853,772 | 12/1974 | Adams | 252/25 |
| 3,907,691 | 9/1975 | King et al. | 252/25 |
| 3,983,042 | 9/1976 | Jain et al. | 252/25 |
| 3,988,248 | 10/1976 | Grasshoff | 252/25 |
| 3,997,454 | 12/1976 | Adams | 252/25 |

*Primary Examiner*—Delbert E. Gantz
*Assistant Examiner*—Irving Vaughn
*Attorney, Agent, or Firm*—D. A. Newell; C. J. Tonkin; J. Tedd Brooks

[57] ABSTRACT

Greases are provided which contain organic grease thickeners and dispersions of finely divided borates as extreme-pressure agents.

5 Claims, No Drawings

GREASES CONTAINING BORATE DISPERSIONS AS EXTREME-PRESSURE ADDITIVES

BACKGROUND OF THE INVENTION

This invention is concerned with improved greases containing particulate dispersions of potassium borate extremepressure agents.

Modern technology is currently supplying the general public and the process industries with machinery which is designed to operate under a wider range of temperatures and under greater loads than previously available. In addition, many of the newer machines are designed to operate at extremely high speeds. Many of these machines require certain specific lubricating properties which are not available in the conventional lubricants. Thus, modernization of high-speed and high-temperature equipment has strained the petroleum industry for the development of a second generation of lubricants capable of satisfying the requirements of the new machines. Recently, for example, there has been an increased demand for lubricants capable of performing well at temperatures above 300° F in highspeed bearings and gears for periods in excess of 500 hours. In addition, with the further development of the high-speed sealed bearings, the lubricant must be able to endure for the life of the bearing.

There have been numerous grease compositions developed which satisfy most of the new, more stringent requirements. Many of these compositions, however, are entirely too expensive for commercialization or only meet some of the lubricating requirements and fail in others. One type of lubricant currently available is the lithium greases. These greases are simply a mixture of a hydrocarbon base oil and a lithium soap such as lithium hydroxy stearate with minor amounts of other additives. These greases exhibit good lubricating properties and perform well at moderate temperatures.

Another type of grease composition which has excellent lubricating properties at the higher temperatures is comprised of a lubricating oil (natural or synthetic) containing a polyurea additive. This type of lubricant is disclosed in U.S. Pat. Nos. 3,242,210, 3,243,372, 3,346,497 and 3,401,027, all assigned to Chevron Research Company. The polyurea component imparts a significant high-temperature stability to the grease and in fact effects a mild anti-thixotropic property, i.e., increases in viscosity with increasing shear, to the lubricant. This property of the lubricant is advantageous to prevent the segregation or loss of grease from the moving parts of the machine. However, the polyurea component does not impart extreme-pressure properties to the lubricant and, accordingly, EP additives must be added in applications involving high contact pressures. A need therefore exists for a grease composition which can be used in high-temperature and high-speed applications that exhibits good stability over prolonged periods, that exhibits both extreme-pressure and antiwear properties, and that is relatively inexpensive to produce. Other greases which often need extremepressure properties are the well-known sodium terephthalamates, aluminum-, calcium- and sodium-based types.

In the past a variety of agents have been employed as EP agents in greases. However, many of these compounds are corrosive to metal. Included among these are phosphorus, sulfur, and chlorine-containing additives such as phosphates, sulfurized ofefins, sulfurized aromatic compounds, chlorinated hydrocarbons, etc. In addition, lead compounds have been employed as EP additives. Environmental concerns have, however, made it desirable to eliminate lead-containing additives from greases. Alkali metal borates, specifically sodium metaborate, have been incorporated in various greases as EP agents with varying degrees of success.

It is thus desirable that grease compositions be provided which possess good EP and antiwear characteristics achieved without enhancement of metal corrosivity and without toxicological problems.

SUMMARY OF THE INVENTION

It has now been found that superior extreme pressure performance is provided by a grease which comprises a major portion of an oil of lubricating viscosity, a minor portion sufficient to thicken the oil to grease consistency of an organic grease thickener and a minor portion sufficient to impart extreme pressure properties of a particulate dispersion of a hydrated potassium borate having a mean particle size of less than one micron and a boron to potassium ratio of about 2.5 to 4.5.

The borate dispersions are added to the greases in the form of a suspension in oil.

Preparation of the Potassium Borate

The novel potassium borate dispersions of this invention are prepared by dehydrating a water-in-oil emulsion of an aqueous solution of potassium hydroxide and boric acid to provide a boron to potassium ratio of 2.5 to 4.5. This is carried out by introducing into the inert nonpolar oil medium an aqueous solution of potassium hydroxide and boric acid (potassium borate solution) and preferably an emulsifier, vigorously agitating the mixture to provide an emulsion of the aqueous solution in the oil and then heating at a temperature and for a time which provide the desired degree of hydration of the microemulsion.

The preparation of the dispersions is disclosed in U.S. Pat. No. 3,997,454, issued Dec. 14, 1976, the teachings of which are incorporated by reference.

The temperature at which the emulsion is heated will generally be at least 120° C and more usually at least 140° C. Temperatures of up to 230° C may be used, although it is preferred that the temperature not exceed 180° C. Lower temperatures may be used at reduced pressures. However, the process is conveniently carried out at atmospheric pressures and at temperatures in the range described.

The time of the reaction will depend upon the degree of dehydration, the amount of water present and the temperature. Time is not critical, and will be determined for the most part by the variables mentioned. The water initially present will be sufficient to dissolve the potassium borate, but should not be in such excess as to make dehydration difficult.

The potassium borate dispersion may be prepared by an alternative method. In this method a potassium carbonateoverbased oil-soluble alkali or alkaline earth metal sulfonate is reacted with boric acid to form a potassium borate reaction product. The amount of boric acid reacted with the potassium carbonate should be sufficient to prepare a potassium borate having a boron to potassium ratio of at least 5. This potassium borate is converted to the potassium borate of this invention by contacting the intermediate borate reaction product with a sufficient amount of potassium hydroxide to prepare the potassium borate having a boron to potassium ratio between 2.5 and 4.5. The water content may be adjusted by adding water or by dehydrating the product in the manner described earlier.

The reaction of the potassium carbonate-overbased metal sulfonate with boric acid and a subsequent reaction with potassium hydroxide may be conducted at a reaction temperature of 20° to 200° C and preferably from 20° to 150° C. A reaction diluent may be present during the two reaction stages and subsequently removed by conventional stripping steps.

Grease Thickeners

The grease thickeners which are employed in the compositions of this invention include a wide variety of materials which are organic in nature but do not include conventional inorganic thickeners such as the various clay thickened materials. It has been found that use of the oil dispersions causes substantial softening of these latter greases.

Thus, the thickeners include various soaps and the polyureas. Included in the soap-type thickeners are lithium, sodium, aluminum and calcium soaps.

The grease thickeners thus include various organic metal salts as well as non-metallic organic thickeners such as the polyureas. Most commonly employed are the organic metal salts, which may be represented by the formula:

$$(RX)nM$$

wherein R represents a saturated or unsaturated alkyl group or an aralkyl group, the R group having from 10 to 30 carbon atoms, 16 to 22 carbon atoms being preferred; X represents a carboxy group, (i.e., a

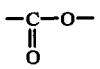

group), a phosphonyl group (i.e., a

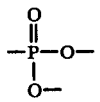

group), a sulfonyl group (i.e., a

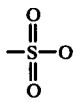

group), or a sulfate group (i.e., a

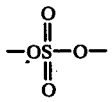

group; and M represents a metal of Groups I, II and III of the Periodic Table. Specifically, M may be sodium, potassium, lithium, calcium, barium, strontium or aluminum. However, it is preferred that M be of Group I of the Periodic Table, sodium and potassium being preferred. *n* represents an integer having a value of 1 or 2, depending on whether M is monovalent or divalent. When M is monovalent, *n* has a value of one; when M is divalent, *n* has a value of two.

The R group may be substituted by polar groups such as chlorine, bromine, alkoxy, hydroxy, mercapto, etc.

Examples of the organic acids which may be used in the formation of the metal salts include lauric acid, myristic acid, palmitic acid, stearic acid, oleic acid, arachidic acid, melissic acid, phenylacetic acid, cetylbenzoic acid, acids resulting from the oxidation of petroleum products (e.g., waxes), cetanesulfonic acid, dedecylbenzenesulfonic acid, dodecanephosphonic acid and lauryl sulfuric acid. Acids of lower molecular weight, such as acetic acid and the like, may be admixed with the acids forming the thickening agents upon conversion to the metal salt, which lower molecular weight acids often beneficially modify the characteristics of the grease compositions.

The organic acid metal salt thickening agent is incorporated in the composition of this invention in amounts sufficient to form the grease. Such amounts as about 1% to about 50% (based on the finished composition) may be used. However, about 3% to about 30% are the preferred amounts.

The preferred thickening agents are the lithium soaps, most preferably lithium 12-hydroxy stearate.

The lithium greases are described in U.S. Pat. Nos. 2,274,673; 2,274,674; 2,274,675; 2,274,676 and 2,293,052.

Aluminum grease thickeners are described in U.S. Pat. Nos. 2,599,553; 2,654,710, 2,768,138; 3,345,291; 3,476,684; and 3,725,275.

Other suitable thickeners are the polyureas disclosed in U.S. Pat. Nos. 3,242,210, 3,243,372, 3,346,497 and 3,401,027, all assigned to Chevron Research Company.

The polyurea of this invention is a water- and oil-insoluble organic compound having a molecular weight between about 375 and 2500 and having at least one ureido group and preferably between about 2 and 6 ureido groups. A ureido group as referred to herein is defined as

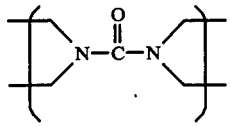

A particularly preferred polyurea compound has an average between 3 and 4 ureido groups and has a molecular weight between about 600 and 1200.

The mono- or polyurea compounds may be prepared by reacting the following components:

I. A diisocyanate having the formula OCN-R-NCO wherein R is a hydrocarbylene having from 2 to 30 carbons and preferably from 6 to 15 carbons and more preferably 7 carbons.

II. A polyamine having a total of 2 to 40 carbons and having the formula

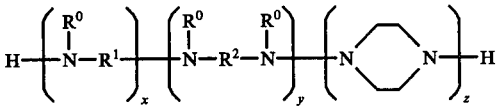

wherein $R^1$ and $R^2$ are the same or different type of hydrocarbylenes having from 1 to 30 carbons and preferably from 2 to 10 carbons and more preferably from 2 to 4 carbons, $R^0$ is selected from hydrogen or a $C_1$-$C_4$ alkyl and preferably hydrogen; *x* is an integer from 0 to 2; $y$ is 0 or 1; and $z$ is an integer equal to 0 when $y$ is 1 and equal to 1 when $y$ is 0.

III. A monofunctional compound selected from the group consisting of monoisocyanate having 1 to 30 carbons, preferably from 10 to 24 carbons, a monoamine having from 1 to 30 carbons, preferably from 10 to 24 carbons, and mixtures thereof.

The reaction can be conducted by contacting the three reactants in a suitable reaction vessel at a temperature between about 60° to 320° F, preferably from 100° to 300° F, for a period from 0.5 to 5 hours and preferably from 1 to 3 hours. The molar ratio of the reactants present usually varies from 0.1-2 mols of monoamine or monoisocyanate and 0–2 mols of polyamine for each mol of diisocyanate. When the monoamine is employed, the molar quantities are preferably (n+1) mols of diisocyanate, ($n$) mols of diamine and 2 mols of monoamine. When the monoisocyanate is employed, the molar quantities are preferably ($n$) mols of diisocyanate, ($n$+1) mols of diamine and 2 mols of monoisocyanate.

A particularly preferred class of mono or polyurea compounds has structures defined by the following general formulas:

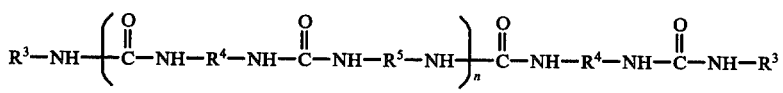

(1)

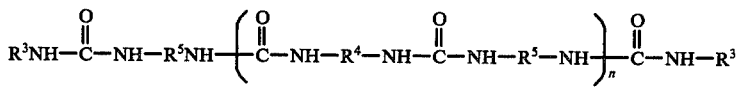

(2)

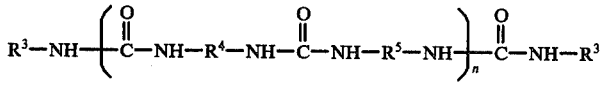

(3)

wherein $n$ is an integer from 0 to 3; $R^3$ is the same or different hydrocarbyl having from 1 to 30 carbon atoms, preferably from 10 to 24 carbons; $R^4$ is the same or different hydrocarbylene having from 2 to 30 carbon atoms, preferably from 6 to 15 carbons; and $R^5$ is the same or different hydrocarbylene having from 1 to 30 carbon atoms, preferably from 2 to 10 carbons.

As referred to herein, hydrocarbyl is a monovalent organic radical composed of hydrogen and carbon and may be aliphatic, aromatic or alicyclic or combinations thereof, e.g., aralkyl, alkyl, aryl, cycloalkyl, alkylcycloalkyl, etc., and may be saturated or olefinically unsaturated (one or more doublebonded carbons, conjugated or nonconjugated). The hydrocarbylene, as defined in $R^1$ and $R^2$ above, is a divalent hydrocarbon radical which may be aliphatic, alicyclic, aromatic or combinations thereof, e.g., alkylarylene, aralkylene, alkylcycloalkylene, cycloalkylarylene, etc., having its two free valences on different carbon atoms.

The mono- or polyureas having the structure presented in Formula (1) above are prepared by reacting ($n$+1) mols of diisocyanate with two mols of a monoamine and ($n$) mols of a diamine. (When $n$ equals zero in the above Formula (1), the diamine is deleted). Mono or polyureas having the structure presented in Formula (2) above are prepared by reacting (n) mols of a diisocyanate with ($n$+1) mols of a diamine and two mols of a monoisocyanate. (When $n$ equals zero in the above Formula (2), the diisocyanate is deleted. Mono- or polyureas having the structure presented in Formula (3) above are prepared by reacting ($n$) mols of a diisocyanate with ($n$) mols of a diamine and one mol of a monoisocyanate and one mol of a monoamine. (When $n$ equals zero in Formula (3), both the diisocyanate and diamine are deleted.)

In preparing the above mono- or polyureas, the desired reactants (diisocyanate, monoisocyanate, diamine and monoamine) are admixed within a suitable reaction vessel in the proper proportions. The reaction may proceed without the presence of a catalyst and is initiated by merely contacting the component reactants under conditions conducive for the reaction. Typical reaction temperatures range from 20° C to 100° C under atmospheric pressure. The reaction itself is exothermic and, accordingly, by initiating the reaction at room temperature, elevated temperatures are obtained. However, external heating or cooling may be desirable.

Reactants

The monoamine or monoisocyanate used in the formulation of the mono or polyurea will form the terminal end groups. These terminal end groups will have from 10 to 30 carbon atoms, but are preferably from 5 to 28 carbons, and more deisrably from 6 to 25 carbons.

Illustrative of various monoamines are pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadecadienylamine, abietylamine, aniline, toluidene, naphthylamine, cumylamine, bornylamine, fenchylamine, tertiary butyl aniline, benzylamine, beta-phenethylamine, etc. Particularly preferred amines are prepared from natural fats and oils or fatty acids obtained therefrom. These starting materials can be reacted wth ammonia to give first amides and then nitriles. The nitriles are then reduced to amines, conveniently be catalytic hydrogenation. Exemplary amines prepared by the method include stearylamine, laurylamine, palmitylamine, oleylamine, petroselinylamine, linoleylamine, linolenylamine, eleostearylamine, etc. The unsaturated amines are particularly preferred.

Illustrative of monoisocynates are hexylisocyanate, decylisocyanate, dodecylisocyanate, tetradecylisocyanate, hexadecylisocyanate, phenylisocyanate, cyclohexylisocyanate, xyleneisocyanate, cumeneisocyanate, abietylisocyanate, cyclooctylisocyanate, etc.

The polyamines, which form the internal hydrocarbon bridges between the ureido groups, usually contain from 2 to 40 carbons and preferably from 20 to 30 carbons, more preferably from 2 to 20 carbons. Exemplary polyamines include diamines such as ethylene diamine, propane diamine, butane diamine, hexane diamine, dodecane diamine, octane diamine, hexadecane diamine, cyclohexane diamine, cyclooctane diamine, phenylene diamine, tolylene diamine, xylylene diamine, dianiline methane, ditoluidine methane, bis(toluidine), piperazine, etc., triamines, such as aminoethyl piperazine, diethylene triamine, dipropylene triamine, N-methyldiethylene triamine, etc., and higher polyamines such as triethylene tetramine, tetraethylene pentamine, pentaethylene hexamine, etc.

Representative examples of diisocyanates include hexane diisocyanate, decane diisocyanate, octadecane diisocyanate, phenylene diisocyanate, tolylene diisocyanate, bis(diphenylisocyanate), methylene bis(-phenylisocyanate), etc.

Another preferred class of mono-polyurea compounds which may be successfully employed in the practice of this invention include the following:

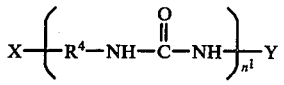

wherein $n^1$ is an integer of 1 to 3, $R^4$ is defined supra, X and Y are monovalent radicals selected from Table I below.

TABLE I

| X | Y |
|---|---|
| $R^7-\overset{O}{\overset{\|}{C}}-NH-$ | $R^7-\overset{O}{\overset{\|}{C}}-NH-R^5-$ |
| 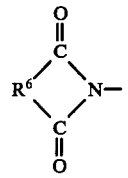 | 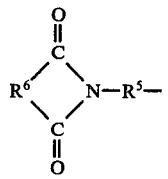 |
| | $R^8-$ |

In the Table, $R^5$ is defined supra, $R^8$ is the same as $R^3$ and defined supra, $R^6$ is selected from the group consisting of arylene radicals of 6 to 16 carbon atoms and alkylene groups of 2 to 30 carbon atoms, and $R^7$ is selected from the group consisting of alkyl radicals having from 10 to 30 carbon atoms and aryl radicals having from 6 l to 16 carbon atoms.

Mono- or polyurea compounds described by the above formula (4) can be described as amides and imides of mono, di and tri ureas. These materials are formed by reacting in the selected proportions of suitable carboxylic acids or internal carboxylic anhydrides, with a diisocyanate and a polyamine with or without a monoamine or monoisocyanate. The mono- or polyurea compounds are prepared by blending the several reactants together in a suitable reaction vessel and heating them to a temperature ranging from 70° F to 400° F for a period sufficient to cause formation of the compound, generally from 5 minutes to 1 hour. The reactants can be added all at once or sequentially.

Suitable carboxylic acids include aliphatic carboxylic acids of about 11 to 31 carbon atoms and aromatic carboxylic acid of 7 to 17 carbon atoms. Examples of suitable acids include aliphatic acids such as lauric, myristic, palmitic, margaric, stearic, arachidic, behenic, lignoceric acid, etc.; and aromatic acids such as benzoic acid, 1-naphthoic acid, 2-naphthoic acid, phenylacetic acid, hydrocinnamic acid, cinnamic acid, mandelic acid, etc. Suitable anhydrides which may be employed are those derived from dibasic acids which form a cyclic anhydride structure, for example, succinic anhydride, maleic anhydride, phthalic anhydride, etc. Substituted anhydrides, such as alkenyl succinic anhydride of up to 30 carbon atoms, are further examples of suitable materials.

Examples of suitable diisocyanates, monoisocyanates, monoamines and polyamines are described supra.

The mono- or polyurea compounds are generally mixtures of compounds having structures wherein $n^1$ varies from 0 to 4, or $n^1$ varies from 1 to 3, existent within the grease composition at the same time. For example, when a monoamine, a diisocyanate and a diamine are concurrently present within the reaction zone, as in the preparation of mono- or polyureas having the structure shown in Formula (2), some of the monoamine may react with both sides of the diisocyanate to form a diurea. In addition to the formulation of diurea, simultaneous reactions can be occurring to form the tri, tetra, penta, hexa, octa, etc., ureas. Particularly good results have been realized when the polyurea compound has an average of 4 ureido groups.

The amount of mono- or polyurea compound in the final grease composition will be sufficient to thicken the base oil to the consistency of grease when combined with the alkaline earth metal carboxylate. Generally, the amount of mono- or polyurea will range from 1 to 15 weight percent and perferably from 2 to 7 weight percent of the final grease composition.

In instances where an oil concentrate is desired, the concentration of the mono- or polyurea compound in the base oil or an oleaginous organic liquid can vary between about 10 and 30 weight percent of the final concentrate. The employment of concentrates provides a convenient method of handling and transporting the mono- or polyurea compounds for subsequent dilution and use.

Base Oil

The third component which must necessarily be present in the composition of this invention is a liquid base oil. The base oils which may be employed herein include a wide variety of lubricating oils such as naphthenic-base, paraffin-base, and mixed-base lubricating oils. Other hydrocarbon oils include lubricating oils derived from coal products and synthetic oils, e.g., alkylene polymers (such as polymers of propylene, butylene, etc., and mixtures thereof), alkylene oxide-type polymers (e.g., alkylene oxide polymers prepared by polymerizing alkylene oxide, e.g., propylene oxide polymers, etc., in the presence of water or alcohols, e.g., ethyl alcohol), carboxylic acid esters (e.g., those which were prepared by esterifying such carboxylic acids as adipic acid, azelaic acid, suberic acid, sebacic acid, alkenyl succinic acid, fumaric acid, maleic acide, etc., with the alcohols such as butyl alcohol, hexyl alcohol, 2-ethylhexyl alcohol, etc.), liquid esters of acid of phosphorus, alkylbenzenes, polyphenols (e.g., biphenols and terphenols), alkyl biphenol ethers, polymers of silicon, e.g., tetraethyl silicate, tetraisopropyl silicate, tetra(4-methyl-2-tetraethyl) silicate, hexyl(4-methyl-2-pentoxy) disilicone, poly(methyl) siloxane, and poly(methylphenyl) siloxane, etc. The base oils may be used individually or in combinations, whenever miscible or whenever made so by use of mutual solvents.

Other Additives

In addition to the mono- or polyurea and alkaline earth metal carboxylate, other additives may be successfully employed within the grease composition of this invention without affecting its high stability and performance over a wide temperature scale. One type of additive is an antioxidant or oxidation inhibitor. This type of additive is employed to prevent varnish and sludge formation on metal parts and to inhibit corrosion of alloyed bearings. Typical antioxidants are organic compounds containing sulfur, phosphorus or nitrogen, such as organic amines, sulfides, hydroxy sulfides, phenols, etc., alone or in combination with metals such as zinc, tin or barium. Particularly useful grease antioxidants include phenyl-alpha-naphthylamine, bis(alkylphenyl)amine, N,N-diphenyl-p-phenylene diamine, 2,2,4-trimethyldihydroquinoline oligomer, bis(4-isopropylaminophenyl) ether, N-acyl-p-aminophenol, N-acylphenothiazines, N-hydrocarbylamides of ethylene diamine tetraacetic acid, alkylphenol-formaldehyde-amine polycondensates, etc.

Another additive which may be incorporated into the grease composition of this invention is an anti-corrodant. The anti-corrodant is employed to suppress attack by acidic bodies and to form protective films over the metal surfaces which decrease the effect of corrosive materials on exposed metallic parts. A particularly effective corrosion inhibitor is an alkali metal nitrite and preferably sodium nitrite. The combination of the polyurea thickener and alkaline earth metal carboxylate has been found to work exceedingly well within the alkali metal nitrite. When this corrosion inhibitor is employed, it is usually used at a concentration of 0.1 to 5 1 weight percent and preferably from 0.2 to 2 weight percent, based on the weight of the final grease composition.

Another type of additive which may be employed herein is a metal deactivator. This type of additive is employed to prevent or counteract catalytic effects of metal on oxidation generally by forming catalytically inactive complexes with soluble or insoluble metal ions. Typical metal deactivators include complex organic nitrogen and sulfur-containing compounds such as certain complex amines and sulfides. An exemplary metal deactivator is mercaptobenzothiazole.

In addition to the above, several other grease additives may be employed in the practice of this invention and include stabilizers, tackiness agents, dropping point improvers, lubricating agents, color correctors, odor control agents, etc.

In preparing the borate dispersions, any suitable dispersant may be used; that is, any dispersant which will disperse the borate in the oil medium. However, it is preferred that the compositions of this invention contain an alkali or alkaline earth metal sulfonate dispersant, and more preferably the compositions contain both a metal sulfonate dispersant and a succinimide dispersant. The ratio of sulfonate to succinimide is a factor in achieving the proper water tolerance properties of the borate lubricant. The sulfonate dispersant is an alkali or alkaline earth metal salt of a hydrocarbyl sulfonic acid having from 15 to 200 carbons. Preferably the term "sulfonate" encompasses the salts of sulfonic acid derived from petroleum products. Such acids are well known in the art. They can be obtained by treating petroleum products with sulfuric acid or sulfur trioxide. The acids thus obtained are known as petroleum sulfonic acids and the salts as petroleum sulfonates. Most of the compounds in the petroleum products which become sulfonated contain an oil-solubilizing hydrocarbon group. Also included within the meaning of "sulfonate" are the salts of sulfonic acids of synthetic alkyl aryl compounds. These acids also are prepared by treating an alkyl aryl compound with sulfuric acid or sulfur trioxide. At least one alkyl substituent of the aryl ring is an oil-solubilizing group, as discussed above. The acids thus obtained are known as alkyl aryl sulfonic acids and the salts as alkyl aryl sulfonates. The sulfonates where the alkyl is straight-chain are the well-known linear alkylaryl sulfonates.

The acids obtained by sulfonation are converted to the metal salts by neutralizing with a basic reacting alkali or alkaline earth metal compound to yield the Group I or Group II metal sulfonates. Generally, the acids are neutralized with an alkali metal base. Alkaline earth metal salts are obtained from the alkali metal salt by metathesis. Alternatively, the sulfonic acids can be neutralized directly with an alkaline earth metal base. The sulfonates can then be overbased, although, for purposes of this invention, overbasing is not necessary. Overbased materials and methods of preparing such materials are well known to those skilled in the art. See, for example, LeSuer U.S. Pat. No. 3,496,105, issued Feb. 17, 1970, particularly Cols. 3 and 4.

The sulfonates are present in the lubricating oil composition in the form of alkali and/or alkaline earth metal salts, or mixtures thereof. The alkali metals include lithium, sodium and potassium. The alkaline earth metals include magnesium, calcium and barium, of which the latter two are preferred.

Particularly preferred, however, because of their wide availability, are salts of the petroleum sulfonic acids, particularly the petroleum sulfonic acids which are obtained by sulfonating various hydrocarbon fractions such as lubricating oil fractions and extracts rich in aromatics which are obtained by extracting a hydrocarbon oil with a selective solvent, which extracts may, if desired, be alkylated before sulfonation by reacting them with olefins or alkyl chlorides by means of an alkylation catalyst; organic polysulfonic acids such as benzene disulfonic acid which may or may not be alkylated; and the like.

The preferred salts for use in the present invention are those of alkylated aromatic sulfonic acids in which the alkyl radical or radicals contain at least about 8 carbon atoms, for example from about 8 to about 22 carbon atoms. Exemplary members of this preferred group of sulfonate starting materials are the aliphatic-substituted cyclic sulfonic acids in which the aliphatic substituent or substituents contain a total of at least 12 carbon atoms, such as the alkyl aryl sulfonic acids, alkyl cycloaliphatic sulfonic acids, and alkyl heterocyclic sulfonic acids and aliphatic sulfonic acids in which the aliphatic radical or radicals contain a total of at least 12 carbon atoms. Specific examples of these oil-soluble sulfonic acids include petroleum sulfonic acid, petrolatum sulfonic acids, mono- and poly-wax-substituted naphthalene sulfonic acids, substituted sulfonic acids, such as cetyl benzene sulfonic acids, cetyl phenyl sulfonic acids, and the like, aliphatic sulfonic acid, such as paraffin wax sulfonic acids, hydroxy-substituted paraffin wax sulfonic acids, etc., cycloaliphatic sulfonic acids, petroleum naphthalene sulfonic acids, cetyl cyclopentyl sulfonic acid, mono- and poly-wax-substituted cyclohexyl sulfonic acids, and the like. The term "petroleum sulfonic acids" is intended to cover all sulfonic acids which are derived directly from petroleum products.

Typical Group II metal sulfonates suitable for use in this composition include the metal sulfonates exemplified as follows: calcium white oil benzene sulfonate, barium white oil benzene sulfonate, magnesium white oil benzene sulfonate, calcium dipolypropene benzene sulfonate, barium dipolypropene benzene sulfonate, magnesium dipolypropene benzene sulfonate, calcium mahogany petroleum sulfonate, barium mahogany petroleum sulfonate, magnesium mahogany petroleum sulfonate, calcium triacontyl sulfonate, magnesium triacontyl sulfonate, calcium lauryl sulfonate, barium lauryl sulfonate, magnesium lauryl sulfonate, etc. The concentration of metal sulfonate which may be employed may vary over a wide range, depending upon the concentration of potassium borate particles. Generally, however, the concentration may range from 0.2 to about 5 weight percent and preferably from 0.3 to 3 weight percent.

In the most preferred embodiment of this invention, from 0.01 to 2 weight percent and preferably from 0.1 to 2 weight percent of a succinimide dispersant is also present in the borate-containing lubricating compositions. These succinimides are usually derived from the reaction of alkenyl succinic acid or anhydride and alkylene polyamines. These compounds are generally considered to have the formula

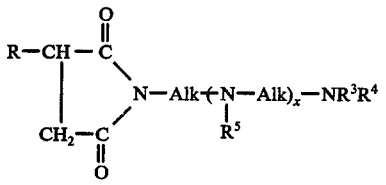

wherein R is a substantially hydrocarbon radical having a molecular weight from about 400 to 3000, that is, R is a hydrocarbyl radical containing about 30 to about 200 carbon atoms; Alk is an alkylene radical of 2 to 10, preferably 2 to 6, carbon atoms, $R^3$, $R^4$ and $R^5$ are selected from a $C_1$–$C_4$ alkyl or alkoxy or hydrogen, preferably hydrogen, and x is an integer from 0 to 6, preferably 0 to 3. The actual reaction product of alkylene succinic acid or anhydride and alkylene polyamine will comprise the mixture of compounds including succinamic acids and succinimides. However, it is customary to designate this reaction product as succinimide of the described formula, since this will be a principal component of the mixture. See U.S. Pat. Nos. 3,202,678, 3,024,237 and 3,172,892.

These N-substituted alkenyl succinimides can be prepared by reacting maleic anhydride with an olefinic hydrocarbon followed by reacting the resulting alkenyl succinic anhydride with the alkylene polyamine. The R radical of the above formula, that is, the alkenyl radical, is preferably derived from an olefin containing from 2 1 to 5 carbon atoms. Thus, the alkenyl radical is obtained by polymerizing an olefin containing from 2 to 5 carbon atoms to from a hydrocarbon having a molecular weight ranging from about 400 to 3000. Such olefins are exemplified by ethylene, propylene, 1-butene, 2-butene, isobutene, and mixtures thereof.

The preferred polyalkylene amines used to prepare the succinimides are of the formula

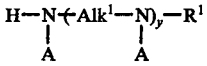

wherein $y$ is an integer from 1 to 10, preferably 1 to 6, A and $R^1$ are each a substantially hydrocarbon or hydrogen radical, and alkylene radical $Alk^1$ is preferably a lower alkylene radical having less than about 8 carbon atoms. The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)imidazoline, 4-methyl imidazoline, N,N-dimethyl-1,3-propane diamine, 1,3-bis(2-aminoethyl-)imidazoline, 1-(2-aminopropyl)-piperazine, 1,4-bis(2-aminoethyl)piperazine and 2-metyl-1-(2-aminobutyl)-piperazine. Higher homologs such as are obtained by condensing two or more of the above-illustrated alkylene amines likewise are useful.

The ethylene amines are especially useful. They are described in some detail under the heading "Ethylene Amines" in *Encyclopedia of Chemical Technology,* Kirk-Othmer, Vol. 5, pp. 898–905 (Interscience Publishers, New York, 1950).

The term "ethylene amine" is used in a generic sense to denote a class of polyamines conforming for the most part to the structure

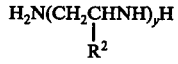

in which $R^2$ is a lower alkyl radical of 1 to 4 carbon atoms or hydrogen and y is as defined above. Thus, it includes, for example, ethylene diamine, diethylene triamine, triethylene tetraamine, tetraethylene pentamine, pentaethylene hexamine, 1,2-diaminopropane, N,N-di(1-methyl-2-aminomethyl) amine, etc.

The mixture of metal sulfonate dispersant and succinimide surface-active dispersant will generally be present in an amount from 0.25 to 5 weight percent, more usually from 0.5 to 3 weight percent, of the composition. The actual amount of dispersant mixture will vary with the particular mixture used and the total amount of borate in the oil. Generally about 0.05 to 0.5, more usually about 0.1 to 0.3 parts by weight, of mixture will be used per part by weight of the potassium borate (in the concentrates, the concentration of each component in the mixture will be based on the relationship to potassium borate rather than on the fixed percentage limits of the lubricant as noted above). Generally, the upper ranges of the dispersant mixture concentration will be used with the upper ranges of the potassium borate concentration.

The dispersion may be added to the finished grease or added to the oil prior to or simultaneously with adding the thickener. taneously with adding the thickener. The greases are prepared by conventional techniques, i.e., the thickener is blended into the oil using conventional blending apparatus such as a 3-ball mill. Preferably the additive is blended into the prepared grease.

EXAMPLE 1

A kettle is charged with 5628 g of 130 neutral petroleum oil, 974 g of a neutral calcium petroleum sulfonate prepared by sulfonating a neutral oil, neutralizing with sodium hydroxide and forming the calcium salt by metathesis with calcium chloride, and 1817 g of a polyisobutenyl succinimide prepared from polyisobutenyl succinic anhydride and tetraethylenepentamine. The contents of the flask are mixed and thereafter a mixture of 12,500 ml of water containing 2870 g of 86% pure potassium hydroxide and 8000 g of ortho boric acid is charged to the flask. The contents are vigorously agitated by a Manton-Gaulin Mill to form a stable microemulsion of the aqueous phase within the oil medium. The emulsion is dehydrated at a temperature of 129° C to yield 11,120 g of product. Infrared analysis shows 5% water in the emulsion. This corresponds to approximately 2.0 waters of hydration left in the potassium borate particles. The particulate borate is calculated to have the empirical formula:

$$K_2O.3B_2O_3.2H_2O$$

The borate is employed in the grease in amounts of from 0.5 to 10%, preferably 1.0 to 5.0% by weight, based on the solids content of the dispersion.

EXAMPLE 2

To greases of various types were added dispersions of the type disclosed in Example 1. The blends were mixed at 140° F and passed through a 3-roll mill. The greases with the borate dispersion were subjected to the Timken Test described in ASTM D-2509. The grease-oil separation test (ASTM D-1742), Worked Penetration (ASTM D-217), Water Washout (ASTM D-1264) and High-Speed Bearing Life (ASTM D-3336) were also determined.

Table II indicates the results of the tests:

TABLE II

| Commercial Grease | Potassium Borate ($KB_3O_5 . H_2O$) Dispersed in Oil Solid wt.% | Worked Penetration, $P_{60}$ Before Additive Addition | Worked Penetration, $P_{60}$ After Additive Addition | Timken Test Max. on Load lbs. | Timken Contact Pressure,** psi | Oil Separation wt.% | Water Washout wt.% | High-Speed Bearing Life at 300° F, Hrs |
|---|---|---|---|---|---|---|---|---|
| Lithium Hydroxy Stearate | 2.5 | 337 | 344 | 60 | 35,000 | 4.7 | 4 | 650 |
| Stearate | 1.5 | 337 | 346 | 55 | | | | |
| Stearate | * | 337 | 365 | 10 | | | | |
| Lithium Base Lead EP Grease | — | — | 347 | 40 - 45 | 12,000 | 9.2 | 19 | 380 |
| Sodium Terephthalamate-thickened Grease | 2.5 | 302 | 342 | 45 | 27,000 | | | |
| Clay-thickened Grease | 2.5 | 327 | Softened to 431 | | | | | |
| Aluminum Complex thickened Grease | 2.5 | 270 | 290 | 50 | 27,000 | | | |
| Calcium Soap-thickened Grease | 2.5 | 286 | 311 | <20 | | | | |
| Polyurea-thickened Grease | 5.0 | 286 | 314 | 70 | 33,000 | | | |

*Contains 2.5 wt.% of $NaBO_2 . H_2O$ dispersed in oil
**Pressure at max. OK load It should be noted that effective EP properties were imparted by the borate dispersions in a variety of greases. The borate dispersion softened a clay grease to a considerable degree. The lithium-base grease containing a dispersion of sodium metaborate showed that it was ineffective as an EP additive with this grease type.

The Timken pressure, water washout, oil separation and high-speed bearing life show the superiority of the borate additives relative to the lead EP additives.

A commercial calcium hydroxy stearate-thickened grease was tested for EP performance with and without the borate additive by the ASTM Method D-2596 Securing Load Wear Index and Weld Point. The results are set forth in Table III.

TABLE III

| Grease | Additive, wt.% | Load Wear Index | Weld Point |
|---|---|---|---|
| Calcium hydroxy stearate thickened grease | — | 22.3 | 110 |
| " | Borate dispersion, 5 | 30.0 | 170 |

These data show that the borate dispersion is an effective EP additive in calcium soap-thickened greases.

While the character of this invention has been described in detail with numerous examples, this has been done by way of illustration only and without limitation of the invention. It will be apparent to those skilled in the art that modificatons and variations of the illustrative examples may be made in the practice of the invention within the scope of the following claims.

What is claimed is:

1. In a grease having extreme-pressure properties comprising an oil of lubricating viscosity, thickened to grease consistency with an organic grease thickener, the improvement comprising the addition of a minor portion sufficient to impart extreme-pressure properties of a dispersion of hydrated potassium borate having a mean particle size of less than one micron and a boron to potassium ratio of about 2.5 to 4.5.

2. The grease of claim 1 in which the thickener is a lithium soap.

3. The grease of claim 1 in which the amount of borate is from about 0.5 to 10% by weight.

4. The grease of claim 1 in which the amount of borate is from about 1.0 to 5% by weight.

5. The grease of claim 1 wherein the potassium borate is dispersed in a combination of an oil-soluble alkali or alkaline earth metal sulfonate and an alkenyl succinimide dispersant.

* * * * *